US007316235B2

(12) United States Patent
Maio et al.

(10) Patent No.: US 7,316,235 B2
(45) Date of Patent: Jan. 8, 2008

(54) PACKAGE FOR CONTAINING AND DISPLAYING COSMETIC PRODUCTS AND PROCESS FOR THE MANUFACTURE THEREOF

(75) Inventors: Giuseppe Maio, Zelo Surrigone (IT); Antonio Mandelli, Cernusco Sul Naviglio (IT)

(73) Assignee: Intercos S.p.A. (IT)

( * ) Notice: Subject to any disclaimer, the term of this patent is extended or adjusted under 35 U.S.C. 154(b) by 0 days.

(21) Appl. No.: 11/220,476

(22) Filed: Sep. 7, 2005

(65) Prior Publication Data

US 2006/0006579 A1 Jan. 12, 2006

Related U.S. Application Data

(62) Division of application No. 10/287,106, filed on Nov. 4, 2002, now Pat. No. 6,953,543.

(30) Foreign Application Priority Data

Dec. 28, 2001 (IT) ..... MI2001A2834

(51) Int. Cl.
*A45D 33/00* (2006.01)
*A45D 33/24* (2006.01)

(52) U.S. Cl. ..... 132/293; 132/294

(58) Field of Classification Search ..... 132/293–297; 206/823, 581; 264/279
See application file for complete search history.

(56) References Cited

U.S. PATENT DOCUMENTS

| | | | | |
|---|---|---|---|---|
| 3,453,056 | A | 7/1969 | Motsavage et al. | |
| 5,431,177 | A * | 7/1995 | Kecman | 132/303 |
| 6,058,942 | A | 5/2000 | Eng | |
| 6,076,533 | A | 6/2000 | Cohen et al. | |
| 6,085,759 | A | 7/2000 | Joulia | |
| 6,149,008 | A * | 11/2000 | Yuhara | 206/581 |
| 6,187,728 | B1 * | 2/2001 | McManus | 510/142 |
| 7,117,874 | B2 * | 10/2006 | Gubernick | 132/294 |

FOREIGN PATENT DOCUMENTS

| | | |
|---|---|---|
| DE | 29 37 441 A | 4/1982 |
| JP | 10-315248 A | 12/1998 |
| WO | WO 00/67704 A | 11/2000 |

* cited by examiner

*Primary Examiner*—Robyn Doan
(74) *Attorney, Agent, or Firm*—Akerman Senterfitt

(57) ABSTRACT

The present invention refers to a package for containing and displaying cosmetic products and to a process for manufacturing the same. The package comprises a component (5) suitable to contain at least one cosmetic product (4). The component (5) is made of a material that is poured and left to harden.

5 Claims, 3 Drawing Sheets

PACKAGE FOR CONTAINING AND DISPLAYING COSMETIC PRODUCTS AND PROCESS FOR THE MANUFACTURE THEREOF

CROSS REFERENCE TO RELATED APPLICATIONS

This application is a divisional of U.S. patent application Ser. No. 10/287,106 filed Nov. 4, 2002 now U.S. Pat. No. 6,953,543, the entire contents of which are incorporated herein by reference. This application also claims the benefit of Italian Patent Application No. MI2001A 002834, filed Dec. 28, 2001.

DESCRIPTION

The present invention refers to a package for containing and displaying cosmetic products and to a process for the manufacture of said package.

Solid cosmetic products are generally marketed in appropriate packages, provided with preformed containers with the same shapes and sizes as the cosmetic products, where the cosmetic products get located and secured with the aim of assuring seal and integrity.

In view of the state of the art described, an object of the present invention is to provide a package for containing and displaying cosmetic products, which is of simpler structure and gives more prominence to the same product.

According to the present invention, these and other objects are attained by means of a package for containing and displaying cosmetic products, comprising a component for containing at least one cosmetic product, characterised in that said component is made of a material that can be poured and can harden.

Said component may be provided inside an outer container or may directly contain the cosmetic product(s).

In addition such objects are attained by means of a process for the packaging of cosmetic products, characterised by comprising the following steps: to pour a hardening material in liquid condition into a container; to wait for partial hardening of said hardening material; to insert at least one cosmetic product into the partially hardened material; to wait for complete hardening of said hardening material.

As an alternative, the cosmetic product may be inserted in the container before pouring the hardening material.

If the hardening component directly contains the cosmetic product(s), the hardening material may be poured and left to harden in a mould, from which the package is extracted at the end of the process. The cosmetic product(s) may be inserted into the hardening material when the material is only partially hardened or when the material is completely hardened; in the latter case, an adhesive material is provided to allow the cosmetic product(s) to adhere to the hardened material.

Owing to the present invention it is possible to provide a package for containing and displaying cosmetic products, which is of simpler structure and does not need additional components in order to enclose the cosmetic products inside the package and in order to keep the cosmetic products spaced from each other.

Moreover, the package according to the invention is particularly advantageous when the cosmetic product is made of pressed powder. In this case, in fact, with respect to the traditional technology with powder pressed into metallic containers, the cosmetic product is subjected to lower mechanical stress and remains particularly soft and comfortable.

The features and the advantages of the present invention will become evident from the following detailed description of embodiments thereof, that are illustrated as non-limiting examples in the accompanying drawings, in which.

Figure 3:
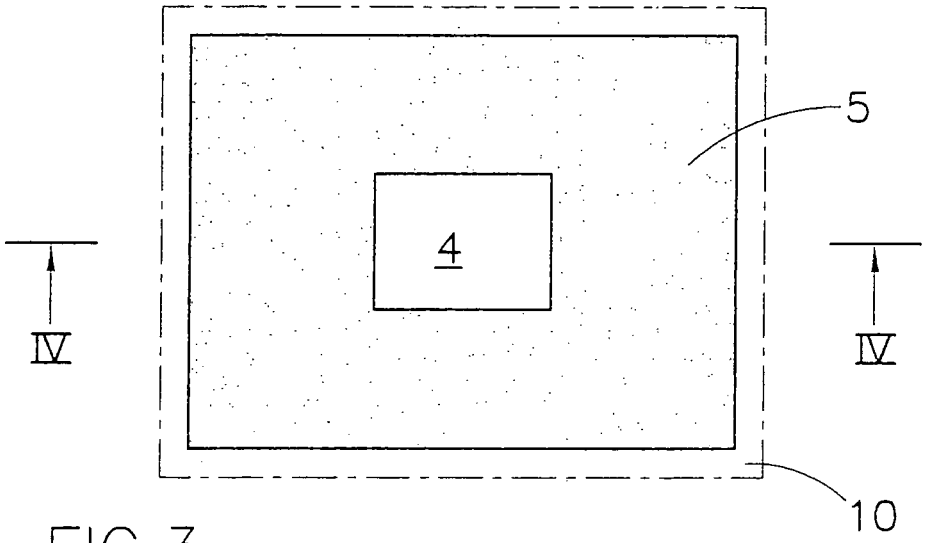
FIG. 3 shows a package for containing and displaying cosmetic products according to a second embodiment of the present invention, as viewed in top plan.
Figure 4A:
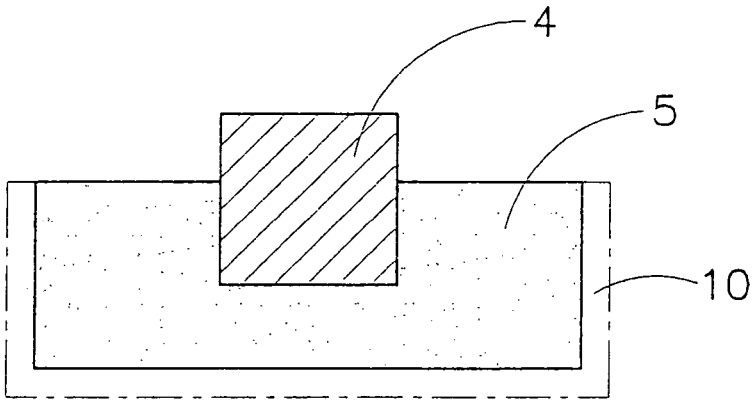
Figure 4B:
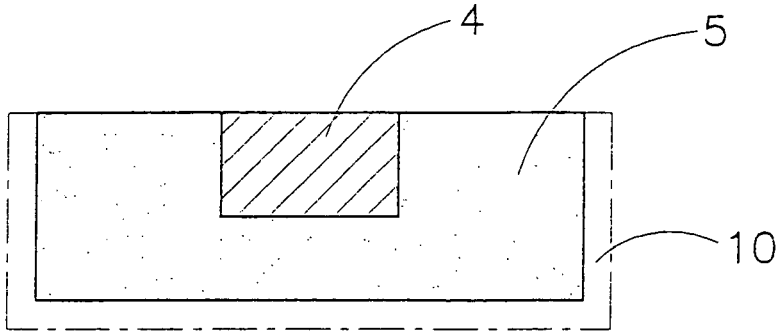
Figure 5:
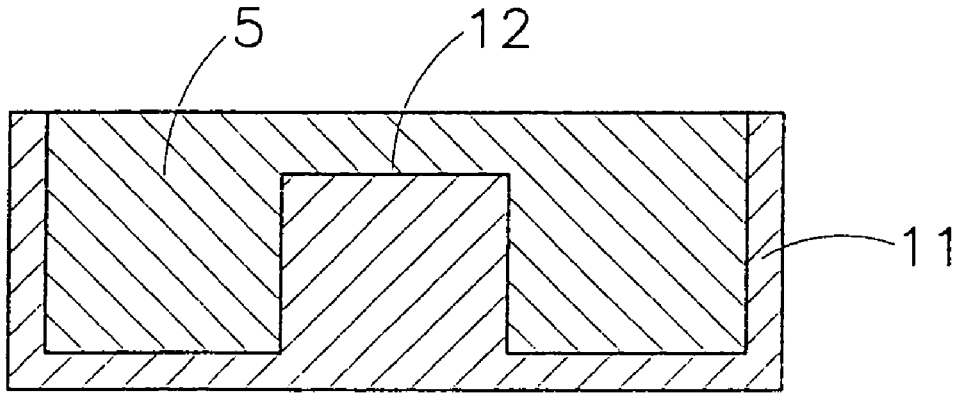

FIG. 4*a* shows a package for containing and displaying cosmetic products according to the second embodiment of the present invention, as viewed in cross-section along line IV-IV of FIG. 3;

FIG. 4*b* is a cross-sectional view similar to FIG. 4*a*, which shows a package for containing and displaying cosmetic products according to a third embodiment of the present invention;

FIG. 5 shows a mould for the manufacture of a package for containing and displaying cosmetic products according to the embodiments of FIGS. 3, 4*a* and 4*b;*

Figure 6:
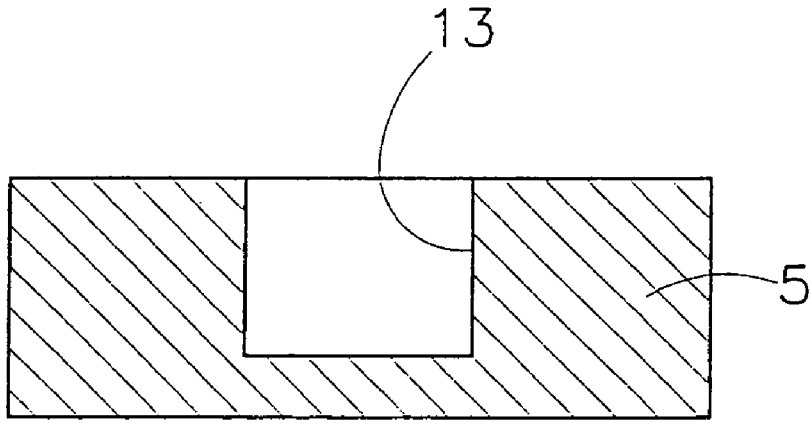

FIG. 6 shows an intermediate step of a manufacturing process which uses the mould of FIG. 5.

Figure 1:
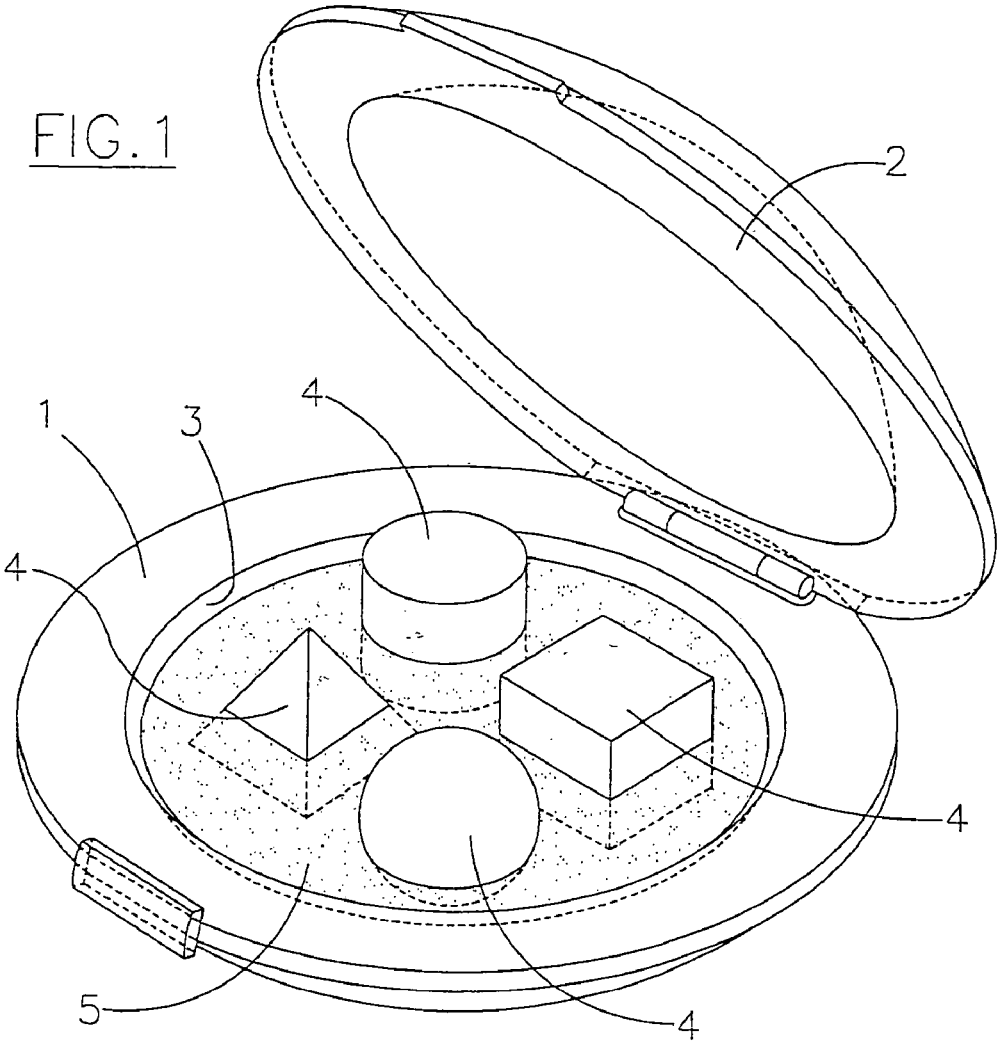
FIG. 1 shows a package for containing and displaying cosmetic products according to a first embodiment of the present invention, as viewed in perspective.
Figure 2:
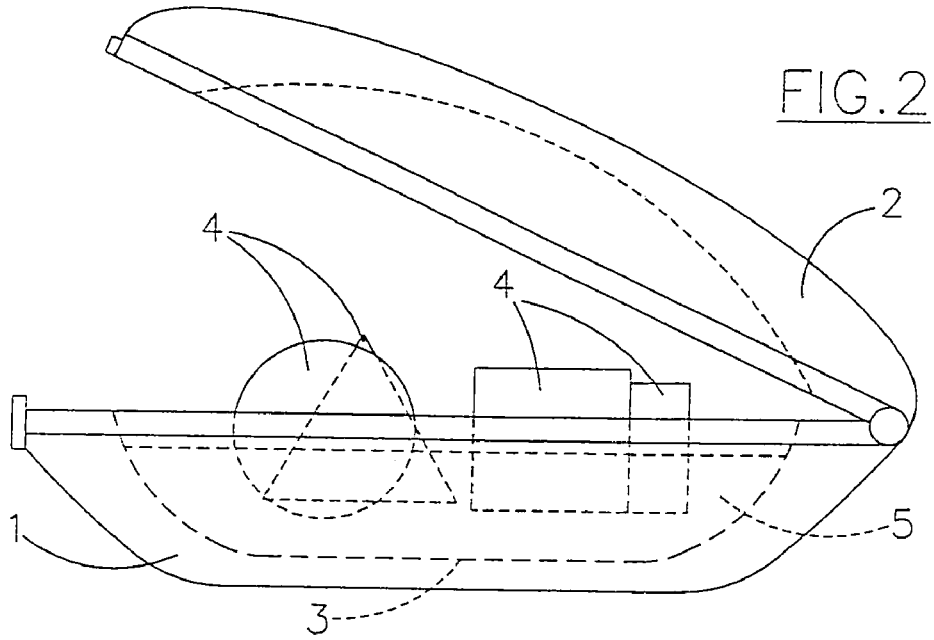
FIG. 2 shows a package for containing and displaying cosmetic products according to the present invention, as viewed in profile.

The package of FIGS. 1 and 2 comprises a container 1 for containing one or more cosmetic products 4 in its cavity 3 and an openable cover 2 for covering the container 1 and therefore covering and protecting the cosmetic products contained therein.

The cosmetic products 4 can be of the same or different type and can have any shape, for instance the shape of cubes, cylinders, parallelepipeds, spheres, rhombi, pyramids and so on, as well as non-geometrical shapes.

The cosmetic product 4 is substantially of a solid type, in particular formed by pressed powder, extruded, poured or otherwise produced.

According to an embodiment of the process according to the invention, the cosmetic product 4 is placed in the cavity 3 of the container 1, in the desired position, then an opportunely prepared hardening material 5 in liquid form is poured into the cavity 3 so as to fill it completely or partially and, in any case, so as to surround the cosmetic product 4 inserted previously. The cosmetic product 4 is surrounded by the material 5 at least at a height suitable to keep the same cosmetic product 4 bound to the component 1.

In an alternative embodiment, a first layer of material 5 is poured, then the cosmetic product 4 is deposited and finally other material 5 is added in order to anchor it.

In a further alternative embodiment, hardening material 5 in liquid form is poured into the container 1 and a sufficient time is waited to allow it to reach such a viscosity that, when the cosmetic product 4 is inserted, the hardening material is prevented from entering inside the cosmetic product. Then the cosmetic product is inserted and the partially hardened material is finally left to harden completely. Preferably, it is possible to protect the cosmetic product 4 from a possible penetration of the material 5 by means of a film forming material, that is a material which, once placed uniformly and continuously on the outer surface of the cosmetic product (or on the outer surfaces in contact with the material 5), creates a barrier which cannot be penetrated by the material 5.

The methods for spreading the film forming material may be several, for example by painting, by dipping the cosmetic product into the film forming material at a suitable depth, by spraying a compressed air jet from a nozzle.

Reference is now made to FIG. 3, which shows a package for containing and displaying cosmetic products according to a second embodiment of the present invention, viewed in top plan.

In this case the container 1 is not used; it is replaced by the material 5. A mould 10 of suitable material, size and shape is prepared and the material 5 is poured into the mould 10 in liquid form. A time is waited which is sufficient to allow the material 5 to reach such a viscosity as to prevent the material 5 from penetrating into the cosmetic product. Then the cosmetic product is placed inside the material 5, it is waited for the complete hardening of the material 5 and the piece formed by the material 5 and the cosmetic product 4 is finally extracted from the mould 10.

It is possible to obtain a finished article of the type shown in FIG. 4*a*, wherein the cosmetic product 4 is partially embedded in the material 5 and a part thereof is outside. Otherwise, it is possible to obtain a finished article of the type shown in FIG. 4*b*, wherein the cosmetic product is entirely embedded in the material 5 with only the top surface thereof exposed.

Reference is now made to FIG. 5, which shows a mould 11 for the preparation of a package for containing and displaying cosmetic products according to the embodiments of FIGS. 4*a* and 4*b*, viewed in cross-section.

In this case the mould 11, differently from the mould 10, has an internal bottom projection 12, preferably at the centre thereof. The material 5 is poured into the mould 11, the time is waited which is necessary for the material to harden and then the hardened material 5 is extracted from the mould and overturned. The material 5 has now the shape shown in FIG. 6, that is with a top recess 13 of the same shape and in the same position as the projection 12 of the mould 11.

The projection 12 may have any shape, which shall substantially correspond (in negative) to the shape of the cosmetic material 4 which will then be inserted into the recess 13 in order to obtain the package shown in FIG. 4*a* or in FIG. 4*b*.

Preferably, when the cosmetic product 4 is inserted into the recess 13, it is possible to introduce a small amount of material 5 in liquid form, which has the purpose of retaining (when hardened) the cosmetic product 4. As an alternative, any type of suitable adhesive may be used.

The material 5 is preferably a resin of the heat-hardening type, that is a resin which is in liquid form when prepared and then hardens after a period of time (at room temperature or at a pre-established temperature depending on the type of resin being used).

For instance, polyurethane, polyester and epoxy resins, possibly mixed according to pre-established ratios and in proper conditions of temperature, may be used.

After 2/8 hours from pouring, the resin forms a solid, resistant mass, that surrounds and secures in a definitive way the cosmetic product 4.

Preferably, the resin 5 is of the transparent type, but it can also be opaque and/or be coloured, and the container 1 and the cover 2 of the package of FIGS. 1 and 2 can be of any type, shape and colour, preferably of a transparent material, that allows a 360° vision of the cosmetic product 4.

A plurality of packages can also be provided that are located in a common package having size suitable to contain them and a single cover.

The moulds 10 and 11 may be of any material which allows the perfect reproduction of the desired shape of the package, has non-adhering features and allows easy extraction of the hardened material 5.

For example, it is possible to use moulds made of two-components silicone rubber, which polymerises at room temperature or at a prefixed temperature, reproduces accurately the initial design and, due to its elasticity and intrinsic non-adherence, allows easy extraction of the hardened piece. As an alternative, moulds of teflon may be used.

The invention claimed is:

1. A cosmetic product and package assembly comprising:

an external container having a bottom wall and a peripheral wall extending upwardly from the bottom wall to define an internal cavity of the container, said peripheral wall having a top surface;

at least one solid cosmetic product housed in said cavity so as to define spaces between said cosmetic product and the peripheral wall of the container, said cosmetic product having a top surface;

a flat hardened layer of heat-hardening pourable resin firmly inserted in said internal cavity by a pouring process to completely fill said spaces up to a height lower than the top surface of the peripheral wall of the container and the top surface of the cosmetic product so as to block said at least one cosmetic product inside said internal cavity while allowing access to the top surface of the cosmetic product.

2. The package according to claim 1, wherein said container is provided with an openable cover.

3. The package according to claim 1, wherein said resin is transparent.

4. The package according to claim 1, wherein said resin is a polyurethane, polyester or epoxy resin, or a mixture thereof.

5. The package according to claim 1, wherein said at least one cosmetic product consists of a plurality of cosmetic products spaced from each other.

* * * * *